US010900487B2

(12) United States Patent
Vestergaard Kragelund et al.

(10) Patent No.: US 10,900,487 B2
(45) Date of Patent: Jan. 26, 2021

(54) PUMP ASSEMBLY

(71) Applicant: GRUNDFOS HOLDING A/S, Bjerringbro (DK)

(72) Inventors: Klaus Vestergaard Kragelund, Risskov (DK); Jan Plougmann, Bjerringbro (DK); Jan Carøe Aarestrup, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 252 days.

(21) Appl. No.: 15/940,048

(22) Filed: Mar. 29, 2018

(65) Prior Publication Data

US 2018/0283383 A1 Oct. 4, 2018

(30) Foreign Application Priority Data

Mar. 31, 2017 (EP) ..... 17164399

(51) Int. Cl.

| | |
|---|---|
| ***F04D 13/06*** | (2006.01) |
| ***F04D 29/42*** | (2006.01) |
| ***F04D 29/12*** | (2006.01) |
| ***F04D 29/62*** | (2006.01) |
| *F04D 1/00* | (2006.01) |

(52) U.S. Cl.

CPC ..... *F04D 13/0626* (2013.01); *F04D 13/0633* (2013.01); *F04D 29/126* (2013.01); *F04D 29/426* (2013.01); *F04D 29/628* (2013.01); *F04D 1/00* (2013.01)

(58) Field of Classification Search

CPC .. F04D 13/0626; F04D 29/046; F04D 29/086; F04D 29/628; F04D 1/00

See application file for complete search history.

(56) References Cited

U.S. PATENT DOCUMENTS

| | | | | |
|---|---|---|---|---|
| 5,005,718 A * | 4/1991 | Buono | B65D 50/041 215/220 |
| 2010/0090635 A1* | 4/2010 | Andersen | H02K 5/10 318/490 |
| 2013/0299346 A1* | 11/2013 | Huebner | C23C 14/3407 204/298.12 |

FOREIGN PATENT DOCUMENTS

| | | | |
|---|---|---|---|
| DE | 41 22 487 C1 | 11/1992 | |
| DE | 199 14 579 A1 | 11/2000 | |
| DE | 19914579 A1 * | 11/2000 | F04D 29/086 |
| DE | 199 43 862 A1 | 3/2001 | |
| DE | 10 2011 014088 A1 | 9/2012 | |

(Continued)

OTHER PUBLICATIONS

Translation of DE 19914579 (Year: 2020).*

*Primary Examiner* — Connor J Tremarche
(74) *Attorney, Agent, or Firm* — McGlew and Tuttle, P.C.

(57) ABSTRACT

A pump assembly (1) includes an impeller (12) with a rotor axis (R), a pump housing (11) accommodating the impeller (12), a drive motor with a stator (14) and a rotor (51) for driving the impeller (12). A rotor can (57) accommodates the rotor (51), and a stator housing (13) accommodates the stator (14). The rotor can (57) includes a rotor can flange (63) having a lateral rotor can flange face (87) fitting within a peripheral wall (69) of the pump housing (11). The lateral rotor can flange face (87) has at least three radial projections (91) abutting against the peripheral wall (69) of the pump housing (11) and centering the rotor can (57) with respect to the peripheral wall (69) of the pump housing (11).

17 Claims, 5 Drawing Sheets

(56) References Cited

FOREIGN PATENT DOCUMENTS

| | | | |
|---|---|---|---|
| EP | 2 072 828 | A1 | 6/2009 |
| WO | 2013/098092 | A1 | 7/2013 |

* cited by examiner

PUMP ASSEMBLY

CROSS REFERENCE TO RELATED APPLICATIONS

This application claims the benefit of priority under 35 U.S.C. § 119 of European Application 17164399.2, filed Mar. 31, 2017, the entire contents of which are incorporated herein by reference.

FIELD OF THE INVENTION

The present disclosure relates generally to pump assemblies, in particular to speed controlled wet rotor pumps. Such pumps in the power range of 5 W to 3 kW are typically used as circulation pumps of house heating systems.

BACKGROUND OF THE INVENTION

Wet rotor pumps usually comprise a rotor can separating a permanent magnet rotor from a stator. The rotor drives an impeller located in a pump housing. Typically, a motor housing is fastened to the pump housing, wherein the rotor can and the stator are attached to the pump housing by the fastener of the motor housing.

EP 2 072 828 A1 describes a wet rotor centrifugal pump as a circulation pump for house heating systems. The pump disclosed therein has a compact design by locating motor electronics at least partially radially around the stator. The motor housing of that pump is attached to the pump housing via a rotor can flange so that the motor housing can be removed without releasing any wet parts.

SUMMARY OF THE INVENTION

In contrast to such known pumps, embodiments of the present disclosure provide a pump assembly with a more compact design.

In accordance with a first aspect of the present disclosure, a pump assembly is provided comprising an impeller with a rotor axis, a pump housing accommodating the impeller, a drive motor with a stator and a wet rotor for driving the impeller, a rotor can accommodating the wet rotor, and a stator housing accommodating the stator, wherein the rotor can comprises a rotor can flange having a lateral rotor can flange face fitting within a peripheral wall of the pump housing, wherein the lateral rotor can flange face has at least three radial projections abutting against the peripheral wall of the pump housing and centering the rotor can with respect to the peripheral wall of the pump housing.

Optionally, the lateral rotor can flange face may be at least partly tapered at one or more of the at least three radial projections with a smaller diameter at the end facing the impeller than at the end facing away from the impeller. This facilitates the insertion of the rotor can flange into the opening defined by the peripheral wall of the pump housing during assembly of the pump.

Optionally, the pump assembly may further comprise a bearing carrier comprising a bearing carrier flange having a lateral bearing carrier flange face fitting within the peripheral wall of the pump housing, wherein the bearing carrier flange is axially placed between the rotor can and an axial annular surface of the pump housing. Analogously to the rotor can flange, the lateral bearing carrier flange face may have at least three radial projections abutting against the peripheral wall of the pump housing and centering the bearing carrier with respect to the peripheral wall of the pump housing. This facilitates further a compact pump design.

Optionally, the lateral bearing carrier flange face may be at least partly tapered at one or more of the at least three radial projections with a smaller diameter at the end facing the impeller than at the end facing away from the impeller. Analogously to the rotor can flange, this facilitates the insertion of the bearing carrier flange into the opening defined by the peripheral wall of the pump housing during assembly of the pump.

Optionally, the pump housing comprises a circumferential groove in an axial annular surface of the pump housing adjacent to the peripheral wall of the pump housing. This is advantageous to accommodate material scraped off when the rotor can flange and/or the bearing carrier flange are inserted into the opening defined by the peripheral wall of the pump housing during assembly of the pump.

Optionally, the rotor can may be mounted by a first coupling to the pump housing and the stator housing is mounted by a second coupling to the pump housing. The second coupling may be releasable without releasing the first coupling. Optionally, the first coupling may be located closer to the rotor axis than the second coupling. This facilitates further a compact pump design.

Optionally, the rotor can may have a first axial end facing the impeller and a second axial end facing away from the impeller, wherein the first axial end is open and the second axial end is closed. The rotor can may be essentially pot-shaped. The rotor can may be shaped by rolling, expanding, cutting, milling and/or punching of a single integral metal piece. Alternatively or in addition, the rotor can may be composed of two or more pieces by welding, crimping or other joining methods.

Optionally, the rotor can may be coupled to the pump housing by a securing member being located around the rotor can and securing the rotor can flange against the pump housing. The securing member may be a union nut or a bracket with an opening through which the rotor can protrudes. Optionally, the securing member may be a union nut, or a bracket, with an opening through which the rotor can protrudes. Preferably, the securing member secures the rotor can flange against the pump housing in axial direction only. Radially, the lateral rotor can flange face is centered via the radial projections with respect to the peripheral wall of the pump housing.

Optionally, a sealing ring may be pressed by the sealing member both axially against the rotor can flange and radially outward against the peripheral wall of the pump housing. Optionally, the securing member may have a conical annular surface for pressing the sealing ring both axially against the rotor can flange and radially outward against the peripheral wall of the pump housing. The peripheral wall of the pump housing may be formed as the radially inner wall of an annular projection projecting axially out of the pump housing. The annular projection may comprise a circumferential outer thread for engaging with a corresponding inner thread of the securing member. The conical annular surface and the inner thread of the securing member may form an annular gap into which the annular projection of the pump housing extends when the securing member is screwed onto the pump housing. No additional fasteners are needed in this embodiment. Alternatively or in addition, the securing member may be a bracket that is secured by fasteners to the pump housing. Preferably, the rotor can may be water-tightly coupled to the pump housing.

Optionally, the second axial end of the rotor can may comprise an at least partially convexly shaped axial end face. For instance, the axial end face may be spherical, ellipsoidal, paraboloidal, cone-shaped or flat with a rounded circumferential edge or chamfer face. Preferably, the axial end of the rotor can facing away from the impeller may be edge-less. This has the advantage of a smoother fluid flow within the rotor can to reduce mechanical resistance caused by turbulence. Furthermore, the at least partially convexly shaped second axial end of the rotor can is mechanically more resistant against pressure shocks (so-called water hammer), which can be as high as 16 bar or more.

Optionally, the at least partially convexly shaped axial end face comprises at least partially a circular curvature in axial direction. For instance, the at least partially convexly shaped axial end face may comprise a flat top face and a rounded edge having a cross-sectional shape of a circle quadrant, said rounded edge connecting the flat top face with a lateral wall of the rotor can.

Optionally, the first coupling comprises an interface for the second coupling. In particular, the securing member may define both the radially more inward first coupling and the second radially more outward coupling. Optionally, the first coupling comprises a fastener in a thread connection with the pump housing. This may be an alternative to the securing member being a union nut. For instance, the securing member may be bracket that is fastened to the pump housing by fasteners in a thread connection.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
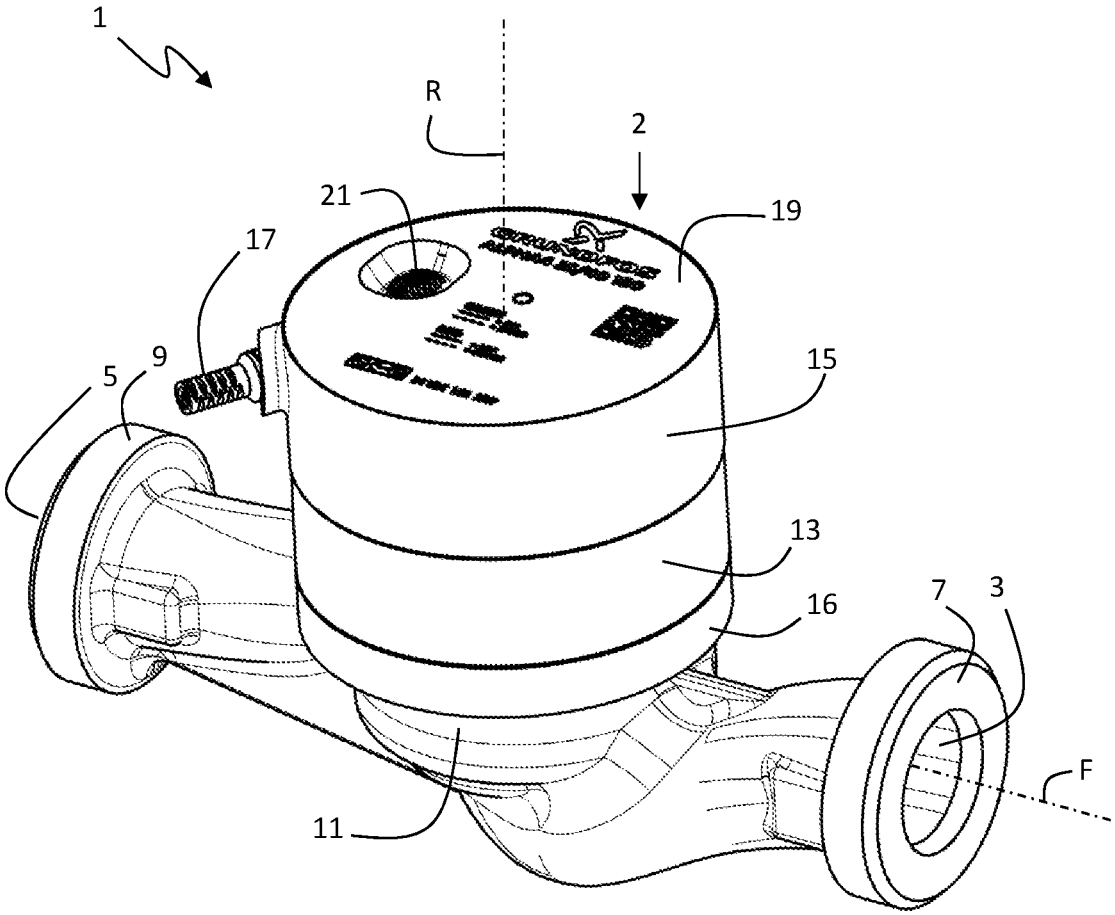
FIG. 1 is a perspective view showing an example of a pump assembly disclosed herein.

Referring to the drawings, FIG. 1 shows a pump assembly 1 with a centrifugal pump unit 2, an input port 3 and an output port 5, wherein the input port 3 and an output port 5 are coaxially arranged on a pipe axis F on opposing sides of the pump unit 2. The input port 3 and the output port 5 comprise connector flanges 7, 9 for a connection to pipes (not shown). The pump unit 2 comprises a rotor axis R essentially perpendicular to the pipe axis F. A pump housing 11 of the pump unit 2 is arranged between the input port 3 and the output port 5. The pump housing 11 comprises an impeller 12 (see FIGS. 3 and 6) for rotating counter-clockwise around the rotor axis R and pumping fluid from the input port 3 to the output port 5. The impeller 12 is driven counter-clockwise by a three-phase synchronous permanent magnet drive motor having a stator located in a stator housing 13 extending from the pump housing 11 along the rotor axis R to an electronics housing 15. The electronics housing 15 has an essentially cylindrical shape like the stator housing 13 and has essentially the same diameter. The stator housing 13 and the electronics housing 15 are essentially coaxially stacked on top of each other along the rotor axis R. The stator housing 13 is mounted to the pump housing by means of a securing member 16 in form of a union nut having essentially the same outer diameter like the stator housing 13 and the electronics housing 15.

The electronics housing 15 comprises motor control electronics on a printed circuit board (PCB) 14 (see FIGS. 3 and 6) for controlling the motor. The motor and motor electronics are power supplied via a low DC voltage connector 17. The pump assembly 1 may comprise an external power supply module (not shown) for connection with the low DC voltage connector 17. The external power supply module may transform an AC line voltage of 110-240V to a low DC voltage of 30-60V. The external power supply may comprise a line filter against electromagnetic interference (EMI) and a voltage converter, which thus do not need to be located on the motor electronics PCB 14. Thus, the motor electronics PCB 14 and the electronics housing 15 may have a more compact design. A top face 19 of the electronics housing 15 may comprise a user interface, such as a button 21, a light-emitting diode (LED) and/or a display (not shown). The button 21 may for instance be an on/off-button. One or more LEDs and/or a display may signal an operating parameter or status, e.g. for indicating a normal operation, a failure mode, a motor speed, a successful/unsuccessful wireless connection, a power consumption, a flow, a head and/or a pressure.

Figure 2:
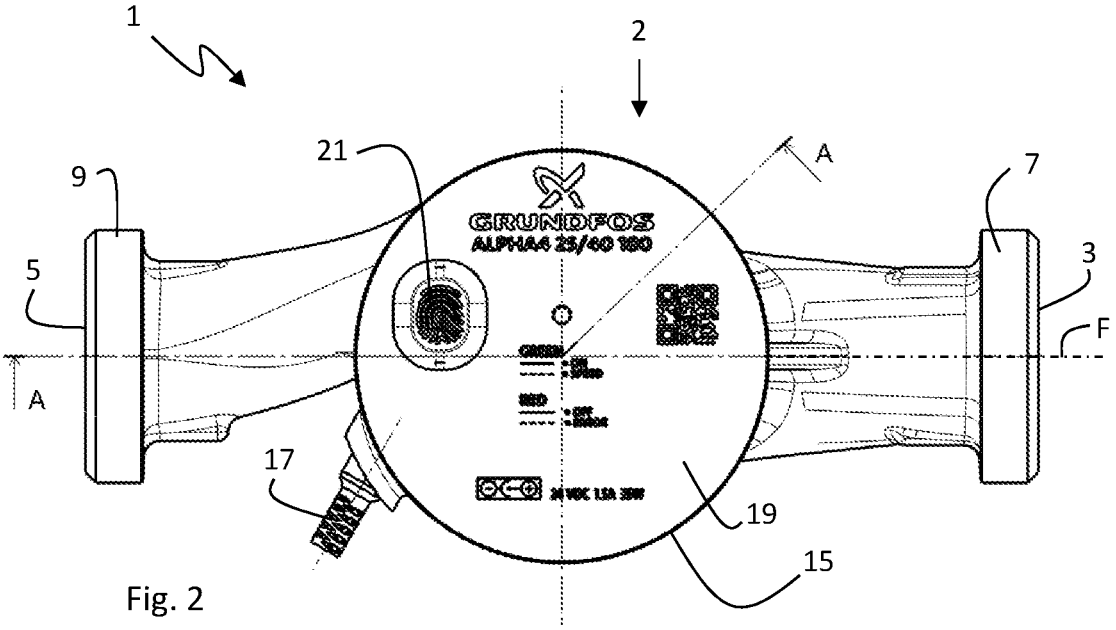
FIG. 2 is a top view on an example of a pump assembly disclosed herein.
Figure 3:
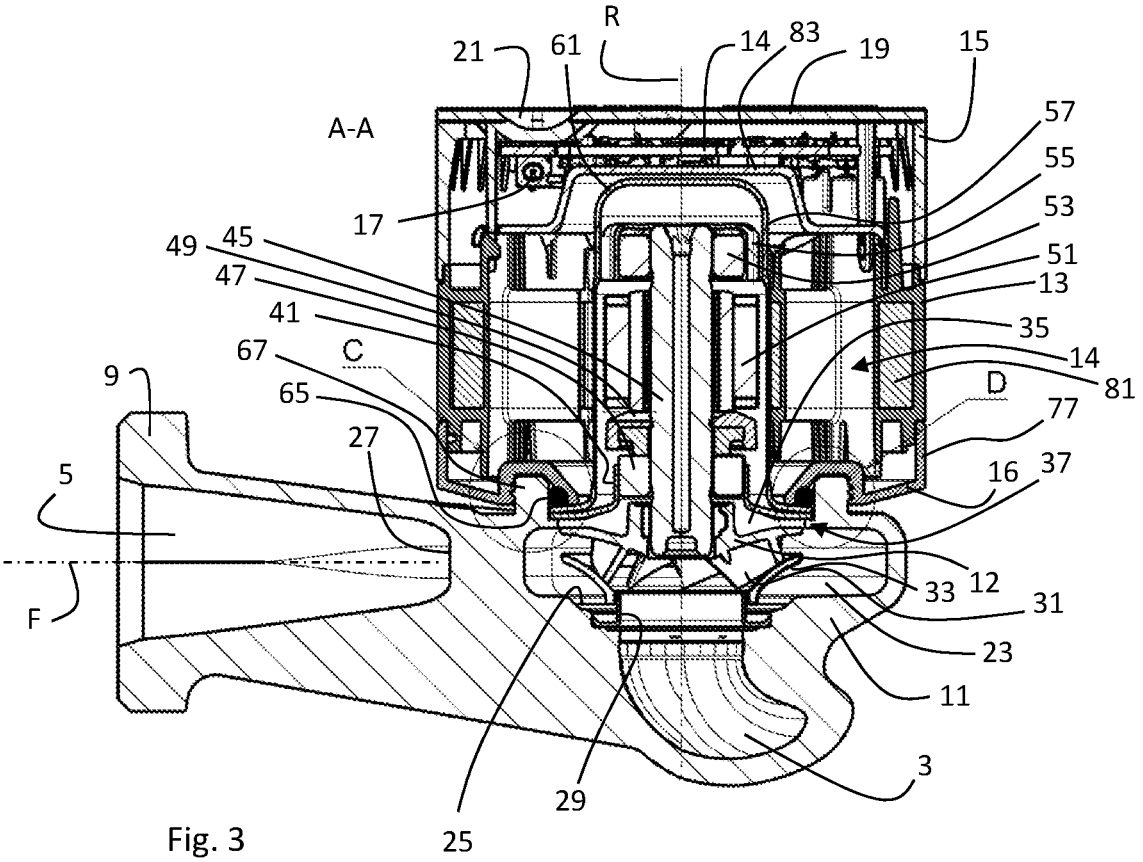
FIG. 3 is a sectional view cut along cut A-A as outlined in FIG. 2 of an example of a pump assembly disclosed herein.

The top view of FIG. 2 shows how the cut A-A shown in FIG. 3 extends through the pump unit 2. The cut view of FIG. 3 displays the very compact pump design achieved by this disclosure. Where FIG. 3 may be too crowded to see a feature clearly, the exploded view of FIG. 4 may be referred to. The inlet port 3 curls from the pipe axis F in a fluid-mechanically efficient way to lead from below coaxially with the rotor axis R into an impeller chamber 23 of the pump housing 11. The impeller chamber 23 has a concentric bottom entry 25 in fluidic connection with the inlet port 3 and a tangential exit 27 in fluidic connection with the outlet port 5. A deflector plate 29 is located concentrically with the rotor axis R at the bottom entry 25 of the impeller chamber 23 to prevent a back-flow of fluid into the inlet port 3. The impeller 12 sits on concentrically on the deflector plate 29. The impeller 12 comprises inner spiral vanes 31 and at its bottom side an impeller plate 33 for forming fluid-mechanically efficient impeller channels for accelerating fluid radially outward and tangentially in counter-clockwise direction by a centrifugal force when the impeller 12 rotates. Such a radially outward and tangentially flow creates a central suction of fluid from the inlet port 3.

The pump housing 11 has an upper circular opening 35 through which the impeller 12 can be placed into the impeller chamber 23 during manufacturing of the pump unit 2. In order to achieve a most compact pump design, the circular opening 35 may have a just slightly larger diameter than the impeller 12. The rim of the circular opening 35 may be formed by a radially inward projection 37 (better visible in detailed views of FIGS. 4 and 5). The radially inward projection 37 forms an axial annular surface 39 on which a bearing carrier 41 resides with a bearing carrier flange 43. A rotor axle 45 extends along the rotor axis R through the bearing carrier 41 and is rotationally fixed with a lower end portion to the impeller 12. The bearing carrier 41 centers a first radial bearing ring 47 being in sliding contact with the rotor axle 45. The rotor axle 45 and the first radial bearing ring 47 may comprise carbon and low friction radial contact surfaces. A very thin lubricating film of the pumped fluid in the range of microns may establish between the rotor axle 45 and the first radial bearing ring 47 when the rotor axle 45 rotates relative to the fixed first radial bearing ring 47. An axial bearing plate 49 is placed on top of the first radial bearing ring 47 to provide a low friction annular top surface. The low friction annular top surface of the axial bearing plate 49 may be wavy or comprise radial channels for fluid flow (better visible in FIG. 4) for establishing a thin lubricating film of the pumped fluid and reducing friction. A permanent magnet rotor 51 embraces the rotor axle 45 and is rotationally fixed to it. A bottom annular surface of the permanent magnet rotor 51 slides during rotation on the fixed low friction annular top surface of the axial bearing plate 49. A second radial bearing ring 53 is in low-friction sliding contact with an upper end of the rotor axle 45. The second radial bearing ring 47 is centered by a bearing bushing 55 with radial extensions and axial channels for allowing an axial fluid flow (better visible in FIG. 4). As the impeller 12 sucks itself together with the rotor axle 45 and the permanent magnet rotor 51 downwards during rotation, only one axial bearing plate 49 is necessary.

The deflector plate 29, the impeller 12, the rotor axle 45, the first radial bearing ring 47, the axial bearing plate 49, the permanent magnet rotor 51, the second radial bearing ring 53 and the bearing bushing 55 are so-called "wet parts" which are all immersed in the fluid to be pumped. The rotating ones of the wet parts, i.e. the impeller 12, the rotor axle 45 and the permanent magnet rotor 51 are so-called "wet-running" using the fluid to be pumped for providing lubricant films for reducing friction at two radial surfaces and one axial contact surface. The fluid to be pumped is preferably water.

The wet parts are enclosed by a pot-shaped rotor can 57 such that fluid can flow between the impeller chamber 23 and the inner volume of the rotor can 57. The rotor can 57 comprises a lower first axial end 59, i.e. the axial end facing the impeller 12, and an upper second axial end 61, i.e. the axial end facing away from the impeller 12 (see FIG. 4). The first axial end 59 is open and defines a rotor can flange 63. The second axial end 61 is closed. The securing member 16 comprises a central opening 64 through which the rotor can 57 protrudes such that the securing member 16 embraces the rotor can 57 and secures the rotor can flange 63 towards the axial annular surface 39 of the radially inward projection 37 at the rim of the upper circular opening 35 of the pump housing 11. The bearing carrier flange 43 is placed between the rotor can flange 63 and the axial annular surface 39 of the radially inward projection 37 of the pump housing 11. Thus, the securing member 16 secures both the rotor can 57 and the bearing carrier 41 via a first coupling. The first coupling is water-tight, because a sealing ring 65 is pressed by the securing member 16 against an upper annular surface of the rotor can flange 63.

The securing member 16 is in this embodiment a union nut with an inner thread 66 being screwed on an outer thread of 65 of an annular projection 67 of the pump housing 11. The annular projection 67 projects axially from the pump housing 11 with a larger diameter than the circular opening 35 and the radially inward projection 37. The annular projection 67 defines the outer thread 65 at its lateral outer side and a peripheral wall 69 at its inner side. The peripheral wall 69 and the axial annular surface 39 of the radially inward projection 37 may form an inner circular edge 71.

The securing member 16 further comprises a conical annular surface 73 forming an annular gap 75 between the conical annular surface 73 and the inner thread 66. The annular projection 67 of the pump housing 11 fits into the annular gap 75 when the securing member 16 is screwed onto the annular projection 67 of the pump housing 11. The conical annular surface 73 urges the sealing ring 65 both axially downward against an upper annular surface of the rotor can flange 63 and radially outward against the peripheral wall 69 of the pump housing 11. Thereby, the wet parts are water-tightly sealed by the one sealing ring 65. This water-tight first coupling of the rotor can 57 to the pump housing 11 by means of the securing member 16 is independent of the mounting of the stator housing 13 or the electronics housing 13. The stator housing 13 and/or the electronics housing 13 can be unmounted without opening the water-tight first coupling between the rotor can 57 and the pump housing 11. In another embodiment (not shown), instead of the inner thread 66 of the securing member 16 as a union nut, the securing member 16 may be a bracket being fastened by axial fasteners in a thread connection with the pump housing 11.

The securing member 16 extends further radially outward defining a lateral side wall 77 having essentially the same diameter as the stator housing 13 and the electronics housing 15. The lateral side wall 77 comprises a second coupling between the securing member 16 and stator housing 13, wherein the second coupling is located radially more outward than the first coupling of the securing member 16 to the rotor can 57. In other words, the securing member 16 provides a radially more inward first coupling of the rotor can 57 to the pump housing 11 and a radially more outward second coupling of the stator housing 13 to the pump housing 11. The securing member 16 may thus provide an interface of the first coupling to the second coupling. The second coupling may be thread connection or a bayonet coupling between the lateral side wall 77 and the stator housing 13. In order to fix the stator housing 13 rotationally, it is preferred that the second coupling closes in clockwise direction, because the driving of the rotor in counter-clockwise direction provokes a counter-torque on the stator 79, which preferably closes the second coupling rather than opening it.

The stator housing 13 encloses a stator 79 with six coils of copper wire windings (not shown) around a ferromagnetic core 81 in a star-shaped arrangement of a speed-controlled three-phase synchronous AC motor. The stator 79 is axially aligned with the permanent magnet rotor 51 for providing a most efficient magnetic flux for driving the permanent magnet rotor 51. The stator housing 13 may be closed on top by a stator housing lid 83 through which electronic contacts of the stator 79 are fed. The electronics housing 15 may be clicked axially onto the stator housing 13 and fixed by a latch connection. The PCB 14 with the motor electronics may extend perpendicular to the rotor axis R parallel to the top face 19 and in close proximity to it allowing a compact design. The PCB 14 are connected with the electronic contacts of the stator 79 fed through the stator housing lid 83. The proximity of the PCB 14 to the top face 19 of the electronics housing 15 allows for a simple design of user interfaces like the button 21, LEDs and/or a display. The user interfaces may be located on the PCB 14 with the top face 19 merely providing windows, holes or mechanical button parts.

It is important to note that the second axial end 61 of the rotor can 57 is not mechanically centered, suspended or supported by the stator housing 13. The rotor can 57 is only fixed at its rotor can flange 63 at its first axial end 59. It is thus preferred that the rotor can 57 has a stable and rigid design to hold against axial and radial forces during operation of the pump unit 2. One feature stabilizing the rotor can 57 is its at least partially convexly shaped second axial end 61. In the embodiment shown in FIG. 3, the edge between a flat top face and the lateral wall of the rotor can 57 is rounded in form of a quarter-circle. In other embodiments (not shown), the second axial end 61 may be spherical, elliptical, ellipsoidal or otherwise cone-shaped. This has a further advantage of a smoother fluid flow within the rotor can 57 to reduce mechanical resistance caused by turbulence.

Figure 5:
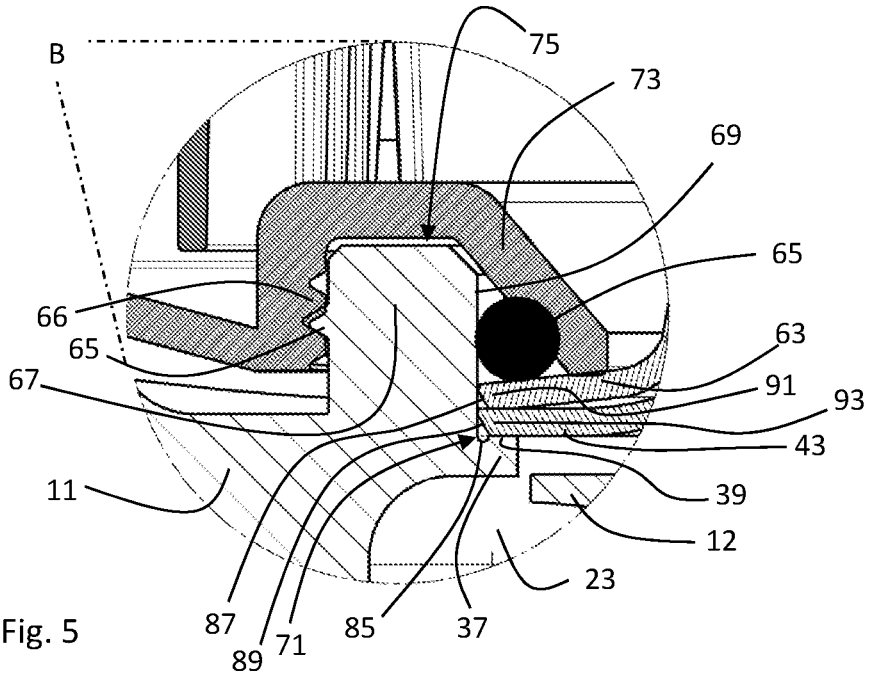
FIG. 5 is a detailed sectional view of detail B, indicated in FIG. 3.

The detail B shown in FIG. 5 gives a better view on the first coupling between the rotor can 57 and the pump housing 11. The securing member 16 is in this embodiment a union nut with the inner thread 66 being screwed on the outer thread of 65 of the annular projection 67 of the pump housing 11. The annular projection 67 defines the outer thread 65 at its lateral outer side and the peripheral wall 69 at its inner side. The peripheral wall 69 and the axial annular surface 39 of the radially inward projection 37 meet at an inner circular edge 71, where a small circumferential groove 85 is located in the axial annular surface 39 adjacent to the peripheral wall 69. The securing member 16 forms the annular gap 75 between the conical annular surface 73 and the inner thread 66. The annular projection 67 of the pump housing 11 fits into the annular gap 75 when the securing member 16 is (as shown) screwed onto the annular projection 67 of the pump housing 11. The conical annular surface 73 urges the sealing ring 65 both axially downward against an upper annular surface of the rotor can flange 63 and radially outward against the peripheral wall 69 of the pump housing 11. The bearing carrier flange 43 is placed between the rotor can flange 63 and the axial annular surface 39 of the radially inward projection 37 in a sandwich configuration. The sealing ring 65 seals both against leakage between the securing member 16 and the rotor can 57 into the stator housing 13, and against leakage between the securing member 16 and pump housing 11 out of the pump unit 2. The conical annular surface 73 may thus have essentially a 45° inclination to urge the sealing ring 65 as much downwards against the rotor can flange 63 as radially outward against the peripheral wall 69.

Figure 4:
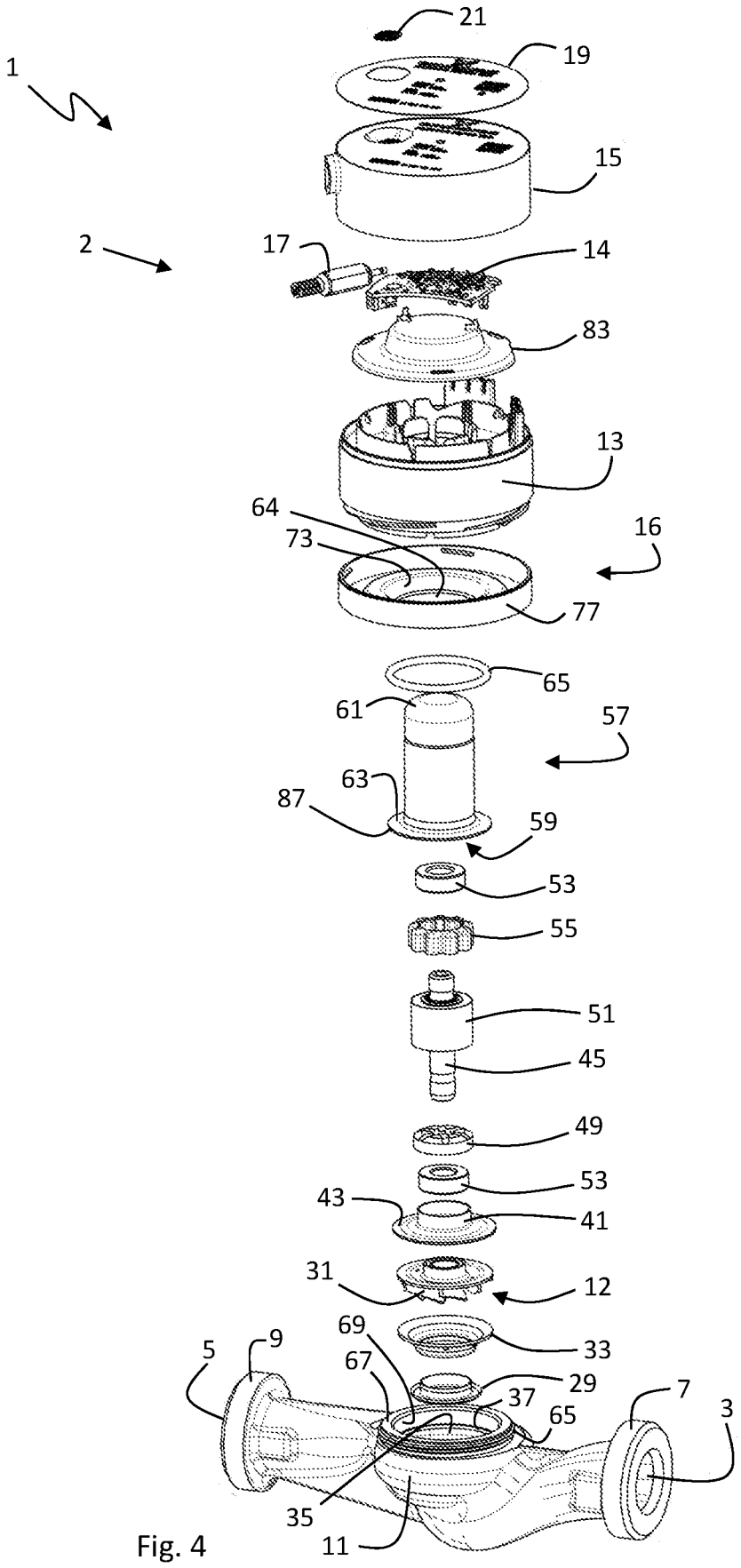
FIG. 4 is an exploded view of an example of a pump assembly disclosed herein.

The rotor can flange 63 has a lateral rotor can flange face 87, and the bearing carrier flange 43 has a lateral bearing carrier flange face 89. Both the lateral rotor can flange face 87 and the lateral bearing carrier flange face 89 may snuggly fit within the peripheral wall 69 of the pump housing 11. Both the rotor can 57 and the bearing carrier 41 are centered by at least three lateral contact points with the peripheral wall 69. FIG. 4 shows one of those contact points. Both the lateral rotor can flange face 87 and the lateral bearing carrier flange face 89 are tapered with a slightly smaller diameter at the bottom end compared to the upper end. This facilitates the insertion of the bearing carrier flange 43 and the rotor can flange 63 into the circular opening defined by the peripheral wall 69. The small circumferential groove 85 located in the axial annular surface 39 adjacent to the peripheral wall 69 is advantageous to accommodate scraped-off material during insertion of the bearing carrier flange 43 and the rotor can flange 63 into the circular opening defined by the peripheral wall 69.

Figure 6:
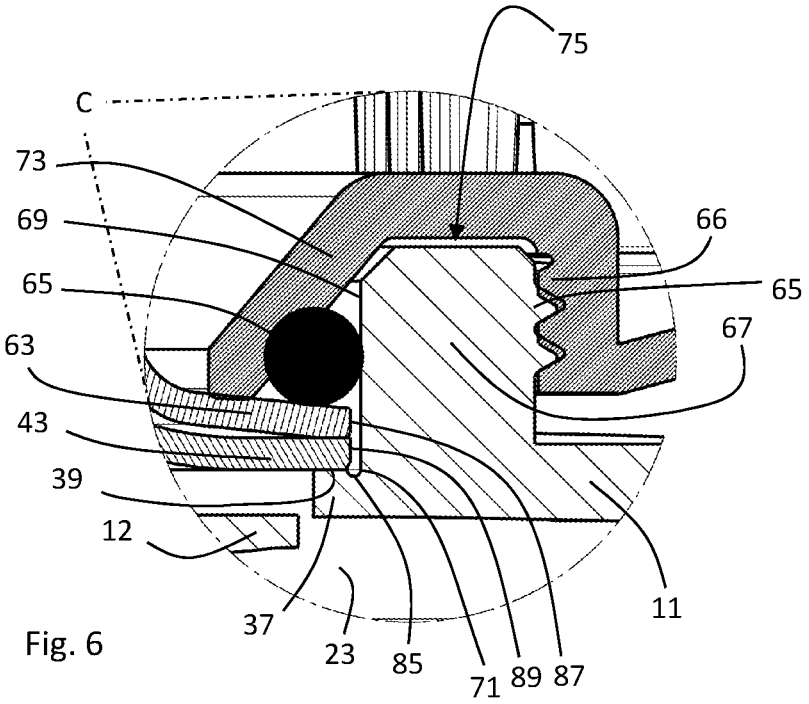
FIG. 6 is a detailed cut view of detail C, indicated in FIG. 3.

The detail C shown in FIG. 6 is a 135° rotated cut view with respect to the detail B shown in FIG. 5. In the detail C shown in FIG. 6, the lateral rotor can flange face 87 and the lateral bearing carrier flange face 89 do not contact the peripheral wall 69. This allows for manufacturing tolerances and thus facilitates the snuggly insertion of the bearing carrier flange 43 and the rotor can flange 63 into the circular opening defined by the peripheral wall 69 by an industrialized machine process.

Figure 7:
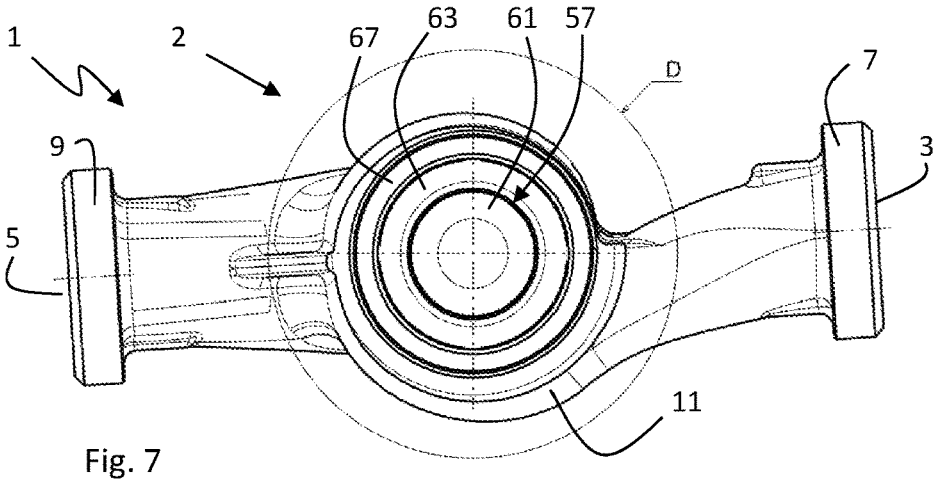
FIG. 7 is a top view on a pump housing and a rotor can of an example of a pump assembly disclosed herein.
Figure 8:
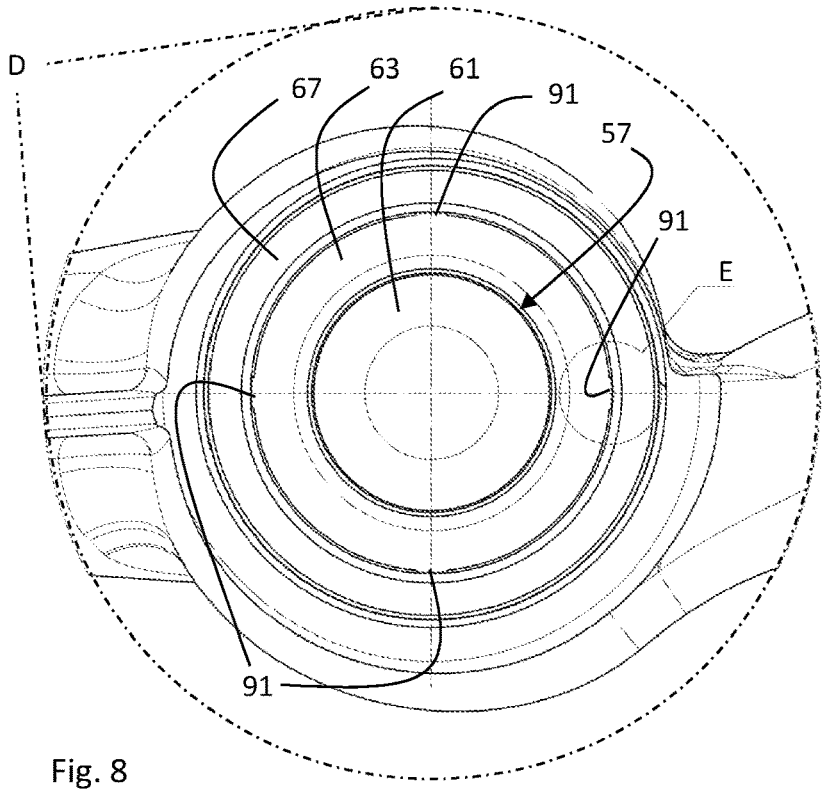
FIG. 8 is a detailed top view of detail D, indicated in FIG. 7.
Figure 9:
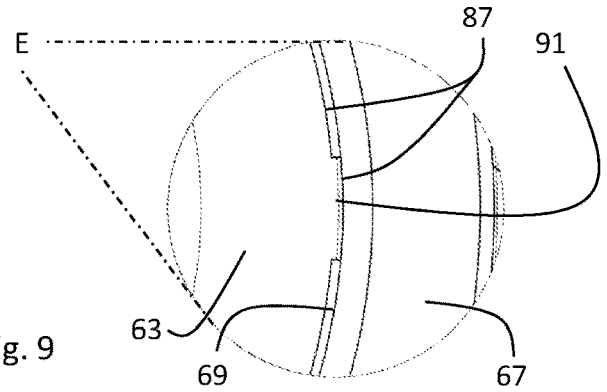
FIG. 9 is a more detailed top view of detail E, indicated in FIG. 8.

It becomes clear in FIGS. 7 to 9 that the lateral rotor can flange face 87 has at least three, here four, radial projections 91 abutting against the peripheral wall 69 and centering the rotor can 57. The four radial projections 91 are circumferentially equally distributed with a 90° angular neighbouring distance. Similarly, the lateral bearing carrier flange face 89 has at least three, here four, radial projections 93 abutting against the peripheral wall 69 and centering the bearing carrier 41. So, detail B of FIG. 4 shows a cut through a radial projection 91 of the lateral rotor can flange face 87 and the radial projection 93 of the lateral bearing carrier flange face 89, whereas detail C of FIG. 5 shows a cut at an angle where there is no radial projection 91, 93 abutting against the peripheral wall 69.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

While specific embodiments of the invention have been shown and described in detail to illustrate the application of the principles of the invention, it will be understood that the invention may be embodied otherwise without departing from such principles.

What is claimed is:

1. A pump assembly comprising:

an impeller with a rotor axis;

a pump housing accommodating the impeller;

a drive motor with a stator and a rotor for driving the impeller;

a rotor can accommodating the rotor, the rotor can comprising a rotor can flange having a lateral rotor can flange face fitting within a peripheral wall of the pump housing, wherein the lateral rotor can flange face has at least three radial projections abutting against the peripheral wall of the pump housing and centering the rotor can with respect to the peripheral wall of the pump housing;

a stator housing accommodating the stator; and a bearing carrier comprising a bearing carrier flange having a lateral bearing carrier flange face fitting within the peripheral wall of the pump housing, wherein the bearing carrier flange is axially placed between the rotor can and an axial annular surface of the pump housing, wherein the lateral bearing carrier flange face has at least three radial projections abutting against the peripheral wall of the pump housing and centering the bearing carrier with respect to the peripheral wall of the pump housing.

2. The pump assembly according to claim 1, wherein the lateral rotor can flange face is at least partly tapered at one or more of the at least three radial projections of the lateral rotor can flange face with a smaller diameter at the end facing the impeller than at the end facing away from the impeller.

3. The pump assembly according to claim 1, wherein the lateral bearing carrier flange face is at least partly tapered at one or more of the at least three radial projections of the lateral bearing carrier flange face with a smaller diameter at an end facing the impeller than at an end facing away from the impeller.

4. The pump assembly according to claim 1, wherein the pump housing comprises a circumferential groove in an axial annular surface of the pump housing adjacent to the peripheral wall of the pump housing.

5. The pump assembly according to claim 1, further comprising:

a first coupling mounting the rotor can to the pump housing; and a second coupling mounting the stator housing to the pump housing.

6. The pump assembly according to claim 5, wherein the second coupling is releasable without releasing the first coupling.

7. The pump assembly according to claim 5, wherein the first coupling is located closer to the rotor axis than the second coupling.

8. The pump assembly according to claim 5, wherein the first coupling comprises an interface for the second coupling.

9. The pump assembly according to claim 5, wherein the first coupling comprises a fastener in a thread connection with the pump housing.

10. The pump assembly according to claim 1, wherein:

the rotor can has a first axial end facing the impeller and has a second axial end facing away from the impeller;

the first axial end is open and the second axial end is closed.

11. The pump assembly according to claim 10, wherein the second axial end of the rotor can comprises an at least partially convexly shaped axial end face.

12. The pump assembly according to claim 11, wherein the at least partially convexly shaped axial end face comprises at least partially a circular curvature in an axial direction.

13. The pump assembly according to claim 1, further comprising a securing member, wherein the rotor can is coupled to the pump housing by the securing member and the securing member is located around the rotor can and secures the rotor can flange against the pump housing.

14. The pump assembly according to claim 13, wherein the securing member is a union nut or a bracket with an opening through which the rotor can protrudes.

15. The pump assembly according to claim 13, further comprising a sealing ring pressed by the sealing member both axially against the rotor can flange and radially outward against the peripheral wall of the pump housing.

16. The pump assembly according to claim 15, wherein the securing member has a conical annular surface for pressing the sealing ring both axially against the rotor can flange and radially outward against the peripheral wall of the pump housing.

17. The pump assembly according to claim 1, wherein the rotor can is water-tightly coupled to the pump housing.

* * * * *